US006897826B1

(12) United States Patent
Kunz

(10) Patent No.: US 6,897,826 B1
(45) Date of Patent: May 24, 2005

(54) RADIO FREQUENCY RADIATION SHIELD UNIT FOR WIRELESS TELEPHONES

(76) Inventor: Kim R. Kunz, 6645 Morro Rd., Atascadero, CA (US) 93422

( * ) Notice: Subject to any disclaimer, the term of this patent is extended or adjusted under 35 U.S.C. 154(b) by 56 days.

(21) Appl. No.: 10/623,093

(22) Filed: Jul. 21, 2003

(51) Int. Cl.[7] ..... H01Q 1/52
(52) U.S. Cl. ..... 343/841; 343/702; 455/575.5
(58) Field of Search ..... 343/841, 851, 343/872, 702, 790; 455/575.5

(56) References Cited

U.S. PATENT DOCUMENTS 5,613,221 A * 3/1997 Hunt ..... 343/841
5,657,386 A * 8/1997 Schwanke ..... 379/433.13
6,088,603 A * 7/2000 Wilson ..... 455/575.5
6,304,224 B1 * 10/2001 Lee ..... 343/702
6,404,403 B1 * 6/2002 Kunz et al. ..... 343/841

* cited by examiner

*Primary Examiner*—Wilson Lee
*Assistant Examiner*—Ephrem Alemu
(74) *Attorney, Agent, or Firm*—Charles C. Logan, II

(57) ABSTRACT

A radio frequency radiation shield unit that is removably mounted on the antenna of a wireless telephone. It has an upright oriented front wall member that is detachably connected to an upright oriented rear wall member. These wall members are fabricated of a plastic material having carbon fibers therein for absorbing and dispersing radiation. A chamber is formed between the front wall member and rear wall member and one or more membranes are positioned therein and these membranes are made of carbon fiber material that has been cut into strips and tightly woven together. A tubular collar is formed on the rear surface of the lower portion of the rear wall member.

13 Claims, 2 Drawing Sheets

RADIO FREQUENCY RADIATION SHIELD UNIT FOR WIRELESS TELEPHONES

BACKGROUND OF THE INVENTION

The present invention is generally related to wireless telephones, and more specifically to a radio frequency radiation shield unit to be installed over the antenna of wireless telephones.

Wireless telephones including, but not limited to cellular telephones, digital telephones, analog telephones, PCS telephones, and personal communication systems (the new generation of wireless communication products), generate radio frequency radiation, including an electromagnetic field ("EMF"), which may prove harmful to persons exposed to such radiation. In recent years, as the number of wireless telephones has grown, so has the concern about tumors or other damage to the brain. Although the level of radiation emitted by such devices is relatively low, the antenna which emits the radiation is close to the head. There is also concern that such radiation can have a cumulative effect.

In the past, there have been some attempts to protect users' of cellular phones from such radiation. However, none of those approaches has been entirely satisfactory. One such protective device for cellular telephone users is illustrated in the Katz, U.S. Pat. No. 5,336,896. Here the entire cellular phone, including the antenna is placed in a shielding enclosure. The cell phone antenna is retracted into the shielding enclosure and makes contact with a second antenna outside the shielding enclosure. The second antenna is mounted on a tilt and swivel base so that it can be moved away from the user's head to reduce exposure to the radiation emanating from it. Even if the energy level is somewhat reduced, the head of the user is still exposed directly to the radiation.

Another prior art patent is that of Schwanke, U.S. Pat. No. 5,657,386. This patent discloses a cellular phone having a shield for protecting the user from electromagnetic radiation emanating from the antenna. The shield is pivotally mounted to the housing of the cell phone and it can be positioned between the antenna and the head of the person using the telephone to protect the person from radiation emitted by the antenna. When the shield is in its protective position, it only shields that portion of the antenna extending upwardly outside of the cellphone housing. The portion of the antenna inside the cellphone housing does not have any of the shield structure blocking radiation emanating therefrom.

A third prior art patent is the Kunz et al, U.S. Pat. No. 6,404,403. This patent discloses a radio frequency shield unit having a housing having an open bottom end that allows it to be slid over the top end of the wireless telephone. The housing also has an aperture in its top end that allows the antenna of the phone to extend upwardly and outwardly therefrom. An antenna shield member extends upwardly from the top end of the housing and it is positioned between the antenna and the head of the person using the telephone to protect the person from radiation emitted by the antenna. In one of its preferred embodiments, the radio frequency radiation shield unit is fabricated of a plastic material having carbon fibers therein for absorbing and dispersing radio frequency radiation.

It is an object of the invention to provide a novel Radio Frequency Radiation ("RFR") shield unit for protecting users of wireless telephones from harmful radiation.

It is also an object of the invention to provide a novel RFR shield unit that will slide down over the top end of the antenna of existing wireless telephones.

It is another object of the invention to provide a novel RFR shield unit fabricated of plastic material having carbon fibers therein for absorbing and dispersing radiation.

It is a further object of the invention to provide a novel RFR shield unit that is easily and quickly installed or removed from existing wireless phones.

It is an additional object of the invention to provide a novel RFR shield unit for wireless telephones that is economical to manufacture and market.

It is also an object of the invention to provide a novel RFR shield unit that has a grounding member extending from its outer surface where it can contact a finger on the hand holding the wireless telephone.

SUMMARY OF THE INVENTION

The radio frequency radiation shield unit has been designed to be removably installed on the antenna of a wireless telephone. Its purpose is to intercept radiation that would be emitted from the antenna toward the head of the user of such a cellphone. The radio frequency radiation shield unit has a front wall member and a rear wall member fabricated of a plastic material having carbon fibers therein for absorbing and dispersing radiation. A recess or chamber is formed in the rear surface of the front wall member for receiving a plurality of membranes for intercepting any radiation that passes through the rear wall member or any apertures therein. Two of these membranes are made of carbon fiber material that has been cut into strips and tightly woven together. The rear surface of the rear wall member has a concave surface that receives and disperses the radiation from the antenna of the cell phone in an extremely effective manner. The third membrane is an all-metal, tinned copper braid shielding tape which is compatible with all high-voltage splicing and terminating materials. It is conformable due to the open-weave knit construction of two No. 36 and AWG tinned copper wires.

The rear wall member has a tubular collar formed integrally therewith extending from its rear surface. Removably insertable therein is a tubular rubber boot member having a vertically oriented bore hole. A leg member extends downwardly from the bottom surface of the tubular collar and it has a disk portion formed thereon. A length of electrical conductor wire has insulation removed from its top end that is positioned between and in contact with two of the previously mentioned membranes. The other end of the electrical wire conductor is threaded through an aperture in the lower portion of the rear wall member and threaded around the tubular boot and then down through a groove in the rear surface of the leg member to the disk at its bottom end. The insulation on the bottom end of the wire conductor is removed and placed in contact with the brass rivet button that passes through the disk member. The combined structure of the membrane members and the carbon fiber impregnated plastic material of the RFR shield unit has been successful in blocking the transmission of better than ninety six percent of the radio frequency radiation emanating from the antenna of a wireless phone. This is a remarkable achievement that is superior to anything presently in the market place.

DESCRIPTION OF THE PREFERRED EMBODIMENT

Figure 1:
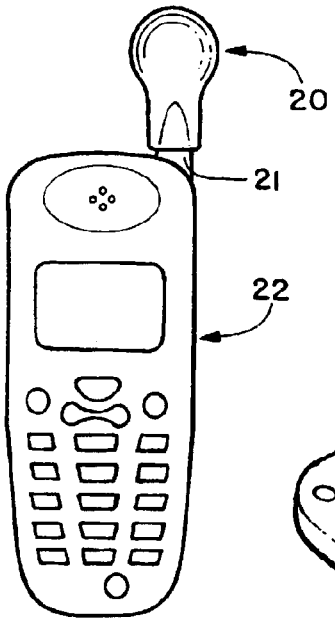
FIG. 1 is a front elevation view of the radio frequency radiation shield unit mounted on a non collapsible wireless telephone.
Figure 2:
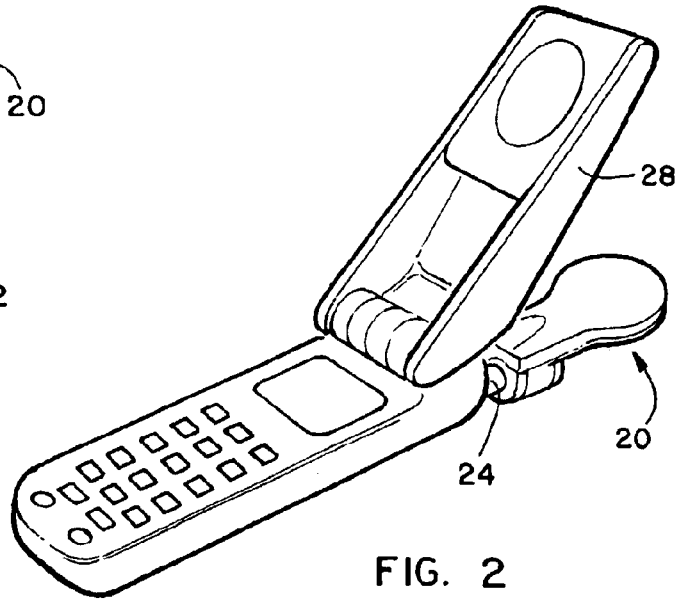
FIG. 2 is a front elevation view of the radio frequency radiation shield unit mounted on the antenna of a collapsible wireless telephone.
Figure 3:
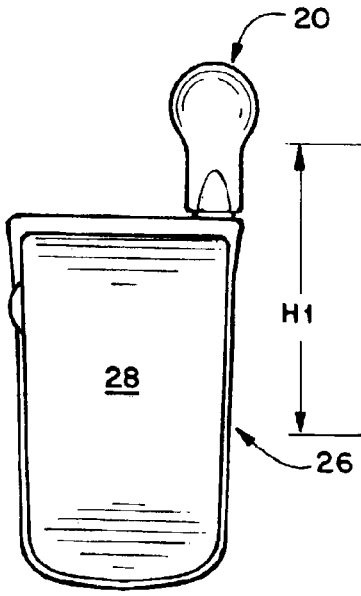
FIG. 3 is a front perspective view of the wireless telephone of FIG. 2 shown in its open position.
Figure 4:
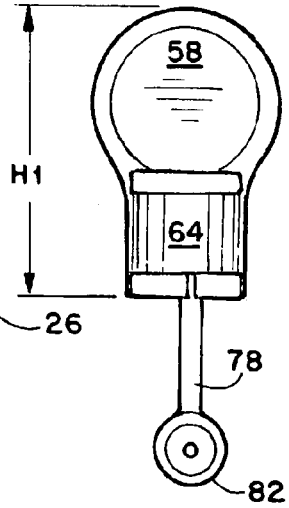
FIG. 4 is a rear elevation view of the radio frequency radiation shield unit.
Figure 5:
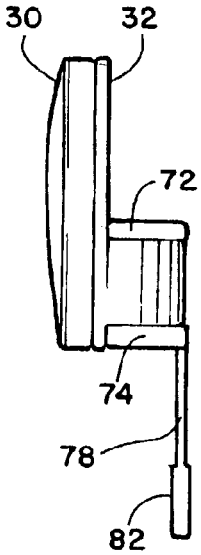
FIG. 5 is a right side elevation view of the radio frequency radiation shield unit.
Figure 6:
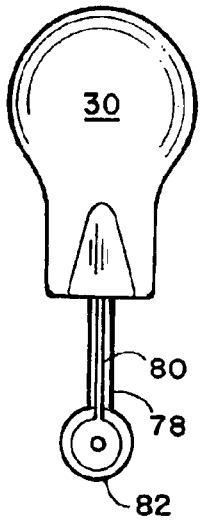
FIG. 6 is a front elevation view of the radio frequency radiation shield unit.

The novel radio frequency radiation shield unit for wireless telephones will now be described by referring to FIGS. 1–11 of the drawings. The novel radio frequency radiation shield unit is generally designated numeral 20 and in FIG. 1 it is shown installed on the antenna 21 of a non-collapsible telephone 22. In FIG. 2, the novel radio frequency radiation shield unit 20 is shown installed on the antenna 24 of a collapsible cellphone 26. Cellphone 26 has a cover 28 pivotally attached thereto which is shown in the open position in FIG. 3 and this is the position when the cell phone is being used.

The structure of the radio frequency radiation shield unit 20 is best understood by referring to FIGS. 4–7 of the drawings. It has a front wall member 30 and a rear wall member 32. Front wall member 30 has a concave rear surface 34 and a rearwardly extending flange 36 around its entire perimeter that forms an interior chamber 38. A pair of apertures 40 are formed in the rear surface of flange 36 for a purpose to be described later.

In the preferred embodiment both front wall member 30 and rear wall member 32 would be both molded and fabricated of a plastic material having carbon fiber therein for absorbing, deflecting and dispersing radio frequency radiation emitted by the antenna of the cellular telephone. A plurality of membranes 42, 43 and 44 nest in interior chamber 38. Membranes 42 and 44 are made of carbon fiber material that has been cut into strips and tightly woven together and captured with a resin bonding agent. Membrane 43, is an all-metal, tinned copper braid shielding tape which is compatible with all high-voltage splicing and terminating materials. It is conformable due to the open weave knit construction of two No. 36 AWG tinned copper wires. Electrical conductor wire 46 has insulation removed from both its ends to expose conductor wire portions 47 and 48. Conductor wire portion 47 passes upwardly through membrane 44 and when it exits rearwardly therefrom it is in direct contact with the rear surface of membrane 43. Front wall member 30 has a height H1 in the range of 0.75–3.0 inches.

Rear wall member 32 has an upper portion 54 and a lower portion 56. Upper portion 54 has a concave surface whose curvature is important in the manner in which it receives radiation from the antenna of the cellphone and the manner in which it distributes radiation throughout rear wall member 32. A pair of pins 50 extend from the front surface of rear wall member 32 and they are removably received in mating apparatus 40. Lower portion 56 has an aperture which allows conductor wire 46 to be fed therethrough. The tubular collar 64 is formed integrally with lower portion 56 and it extends rearwardly therefrom. Collar 64 has a height H2 and H2 is in the range of 0.375–1.50 inches.

Tubular boot 68 is made of non-electrical conductive material such as rubber which is flexible and can telescopically compressed into the interior of tubular collar 64. Tubular boot 68 has a cylindrical bore hole 70 that has a width W1. Tubular boot 68 also has an upper flange 72 and a lower flange 74 that provides a spacing within tubular collar 64 through which electrical conductor 46 can be threaded. The slot 76 in lower flange 74 allows the electrical conductor wire 46 to be inserted downwardly therethrough. A leg 78 is formed integrally with flange 74 and extends downward therefrom. It has a rear surface having a longitudinally extending groove 80 into which electrical wire 46 is matingly received. A disk 82 is integrally formed on the bottom end of leg member 78. It has recesses 83 formed in the front and rear surfaces and an aperture 84 passing axially therethrough. A brass conductor button 86 has a shank portion 87 that passes through aperture 84 and which is crimped over the bottom end of wire 48. The bottom end 48 of electrical conductor wire 46 would be in direct contact with shank portion 87 and functions as a ground. Brass button 86 could be also be formed as an integral member having a head formed on shank portion 87 that would be forced through aperture 84 and pop out the opposite end. A strip of double adhesive sided tape 90 is attached to the rear surface of leg member 78 to capture electrical wire 46 in groove 80 and also the other side of the tape would contact and adhere to the telephone body.

Figures 7, 8, 9, 10, 11:
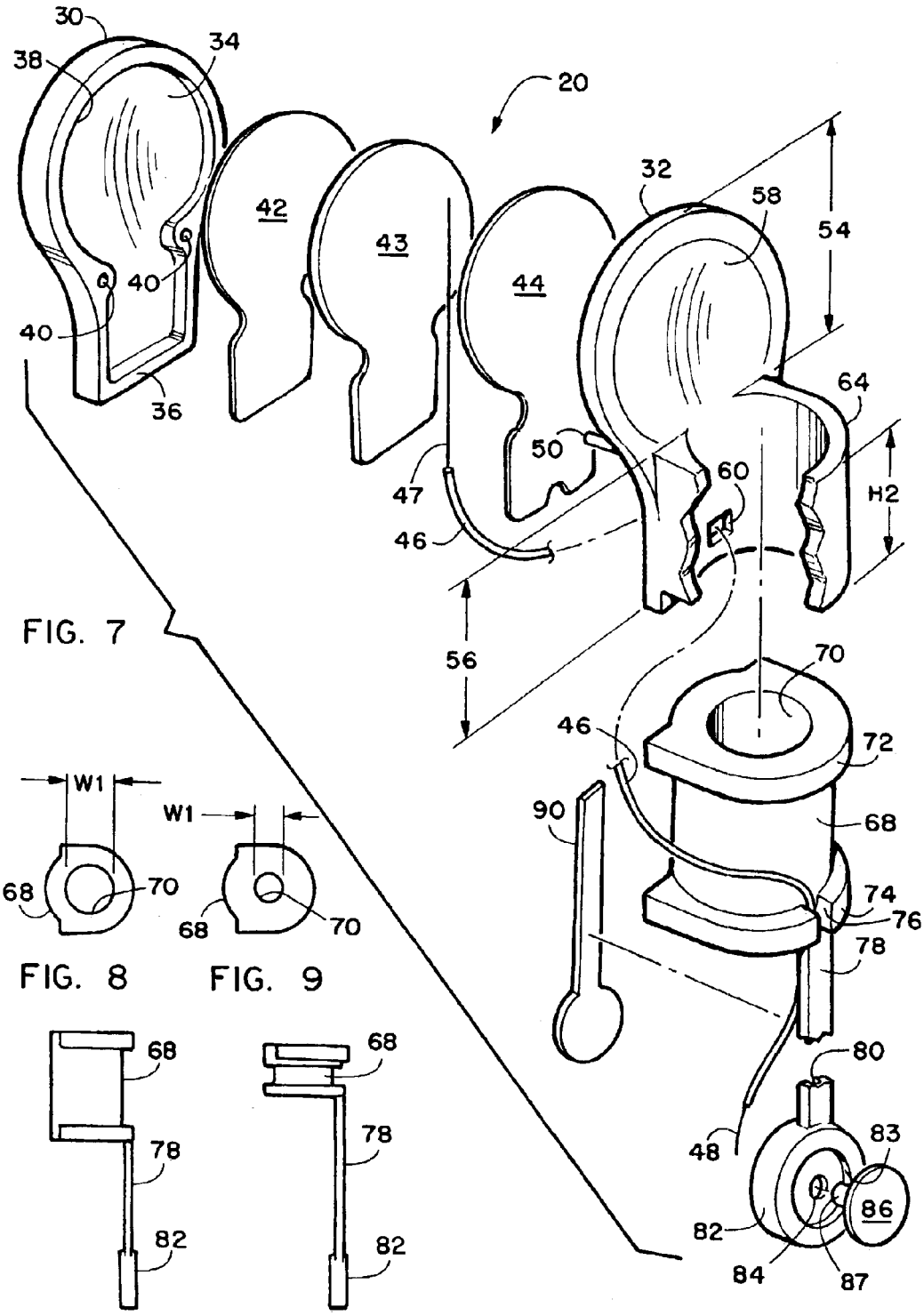
FIG. 7 is an exploded rear perspective view of the radio frequency radiation shield unit.
FIG. 8 is a top plan view of a first tubular boot member that is utilized with the radio frequency radiation shield unit having a first predetermined diameter.
FIG. 9 is a top plan view of a first alternative embodiment of the tubular boot member having a different tubular diameter.
FIG. 10 is a right side elevation view of the tubular boot member showing it having a predetermined height.
FIG. 11 is a right side elevation view of a first alternative embodiment tubular boot member having a different predetermined height.

FIGS. 8 and 9 show tubular boot 68 having a bore having different widths W2 that mate with different width antennas on different cellphones. FIGS. 10 and 11 show the tubular boot 68 having different heights to mate with different sized antennas on the different models of cellphones.

What is claimed:

1. A radio frequency radiation shield unit for wireless telephones comprising:

an upright oriented front wall member having a front surface, a rear surface, a height H1, a top edge, a left edge, a right edge and a bottom edge;

an upright oriented rear wall member having a front surface, a rear surface, a height H1, a top edge, a left edge, a right edge and a bottom edge; said rear wall member having an upper portion and a lower portion;

spacing means for laterally spacing said front wall member from said rear wall member to form a primary chamber therebetween; said primary chamber having a top end and a bottom end;

attachment means for attaching said front wall member to said rear wall member; and means for securing said rear wall member to an antenna of a wireless telephone comprising an upright oriented tubular collar connected to said rear surface of said lower portion of said rear wall; said tubular collar having an open top end and an open bottom end and a height H1; said tubular collar having a minor chamber extending from said open top end to said open bottom end; an aperture is formed in said rear wall member in communication with said primary chamber and said minor chamber.

2. A radio frequency radiation shield unit for wireless telephones as recited in claim 1 wherein said rear wall member is fabricated of a plastic material having carbon fibers therein for absorbing and dispersing radiation.

3. A radio frequency radiation shield unit for wireless telephones as recited in claim 1 wherein H1 is in the range of 0.75–3.0 inches.

4. A radio frequency radiation shield unit for wireless telephones as recited in claim 1 wherein said rear surface of said upper portion of said rear wall member has a concave configuration.

5. A radio frequency radiation shield unit for wireless telephones as recited in claim 1 wherein said primary chamber extends substantially from said top edge to said bottom edge of said respective front and rear wall members.

6. A radio frequency radiation shield unit for wireless telephones as recited in claim 1 further comprising at least one membrane positioned in said primary chamber between said rear surface of said front wall member and said front surface of said rear wall member; said membranes being made of carbon fiber material that has been cut into strips and tightly woven together.

7. A radio frequency radiation shield unit for wireless telephones as recited in claim 6 wherein some of the RFR that is absorbed by said carbon fibers of said rear wall member are directed into a flow of electrons and said radio frequency radiation shield unit has grounding means having a first end and a second end, said first end being connected to said flow of electrons.

8. A radio frequency radiation shield unit for wireless telephones as recited in claim 1 wherein said RFR that is absorbed by said carbon fibers of said rear wall member are directed into a flow of electrons and said radio frequency radiation shield unit has grounding means having a first end and a second end, said first end being connected to said flow of electrons; and said grounding means comprises an electrical wire.

9. A radio frequency radiation shield unit for wireless telephones as recited in claim 8 wherein said electrical wire passes through said aperture in said rear wall member.

10. A radio frequency radiation shield unit for wireless telephones as recited in claim 9 further comprising a brass button rivet connected to said rear end of said electrical wire.

11. A radio frequency radiation shield unit for wireless telephones as recited in claim 10 further comprising a tubular rubber boot that is compressibly inserted into said tubular collar; said tubular rubber boot having a top end and a bottom end, said tubular collar having a bore hole extending from said top end to said bottom end for removably receiving the antenna of a wireless telephone.

12. A radio frequency radiation shield unit for wireless telephones as recited in claim 11 further comprising an upright oriented elongated leg member having a top end, a bottom end and a front surface; a groove extends along said front surface of said leg member from said top end to said bottom; a portion of the length of said electrical wire is removably captured in said groove.

13. A radio frequency radiation shield unit for wireless telephones as recited in claim 12 further comprising a disk member formed on said bottom end of said leg member and an aperture is formed in said disc member for receiving said brass button rivet.

* * * * *